US006843869B2

(12) United States Patent
Mendenhall et al.

(10) Patent No.: US 6,843,869 B2
(45) Date of Patent: Jan. 18, 2005

(54) POROUS IGNITER FOR AUTOMOTIVE AIRBAG APPLICATIONS

(75) Inventors: Ivan V. Mendenhall, Providence, UT (US); Robert G. Smith, North Ogden, UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 10/313,819

(22) Filed: Dec. 6, 2002

(65) Prior Publication Data

US 2004/0108029 A1 Jun. 10, 2004

(51) Int. Cl.[7] ..... D03D 23/00
(52) U.S. Cl. ..... 149/109.6; 149/108.6
(58) Field of Search ..... 149/108.6, 109.6, 149/22, 61

(56) References Cited

U.S. PATENT DOCUMENTS 3,954,062 A 5/1976 Dunlop et al.
4,151,022 A * 4/1979 Donaghue et al. ..... 149/19.4
4,758,287 A 7/1988 Pietz
5,230,841 A 7/1993 Redecker et al.
6,340,175 B1 1/2002 Hughes et al.

FOREIGN PATENT DOCUMENTS

| | | |
|---|---|---|
| EP | 0 864 553 A1 | 9/1998 |
| EP | 1 000 916 A1 | 5/2000 |
| FR | 2 508 896 | 1/1983 |
| GB | 2 258 229 | 2/1993 |
| WO | WO 00/21907 | 4/2000 |

* cited by examiner

*Primary Examiner*—Aileen Felton
(74) *Attorney, Agent, or Firm*—Sally J. Brown

(57) ABSTRACT

A porous igniter body and a method of making the same are provided wherein a blowing agent component including at least one thermally decomposable blowing agent solid is mixed with at least one igniter fuel and at least one igniter oxidizer to form an igniter body precursor. The igniter body precursor is subsequently subjected to a temperature sufficient to decompose at least a portion of the blowing agent to form the porous igniter body.

33 Claims, 1 Drawing Sheet

POROUS IGNITER FOR AUTOMOTIVE AIRBAG APPLICATIONS

BACKGROUND OF THE INVENTION

This invention relates generally to igniter materials such as for use in inflatable restraint systems and, more specifically, to porous igniter materials such as for use in devices, systems and methods used in the inflation of an automotive safety restraint system inflatable vehicle occupant restraint airbag cushion.

It is well known to protect a vehicle occupant using a cushion or bag, e.g., an "airbag," that is inflated or expanded with gas when the vehicle encounters a sudden deceleration, such as in the event of a collision. In such systems, the airbag cushion is normally housed in an uninflated and folded condition to minimize space requirements. Upon actuation of the system, the cushion begins to be inflated in a matter of no more than a few milliseconds with gas produced or supplied by a device commonly referred to as an "inflator."

Many types of inflator devices have been disclosed in the art for use in inflating one or more inflatable restraint system airbag cushions. Many prior art inflator devices include a solid form of gas generant material which is burned to produce or form gas used in the inflation of an associated airbag cushion.

Such inflator devices tend to involve a chain of reactions of materials, e.g., pyrotechnics, contained within an inflator device to produce or generate an inflation medium, e.g., inflation gas, to result in the deployment of an airbag cushion. For example, such devices commonly employ a squib or initiator which is electrically ignited when a collision is sensed. The discharge from the squib in turn ignites or lights an igniter material. The igniter material desirably burns relatively rapidly, with a large caloric output, such as to desirably relatively uniformly ignite a supply of gas generant material. The gas generant material in turn bums to produce or form gas such as is directed into the airbag cushion to effect inflation thereof. In general, the ballistic properties of a gas generant material are controlled by the shape (usually tablets or wafers) and burn rate of the gas generant.

As will be appreciated, rapid and repeatable ignition of a gas generant material is critical to providing inflator devices that enable an airbag cushion to reliably deploy in the very short periods of time associated with vehicle occupant passive restraint installations. For example, inflator designers typically require the period of time following actuation till gas expelled from an inflator can be measured to be less than 3 milliseconds.

Inflator design attempts to incorporate a simply mixing or blending together of an igniter powder with gas generant tablets, wafers, or other gas generant particle shapes have generally not proven successful. In particular, igniter powders in such inflator designs over time tend to be susceptible to migration away from the squib and the gas generant particles. Consequently, such designs may experience unacceptable ignition delays and produce or result in less than optimal occupant protection.

In view thereof, conventional inflator devices have commonly employed some form of igniter material packaging to ensure the proper placement and positioning of the igniter material to effect desired ignition and reaction of the associated gas generant material. More specifically, it is common for inflator devices to employ a powdered igniter material that is packaged within the inflator in close proximity to the squib and to the gas generant. In such an arrangement, the squib is able to rapidly light the igniter material and the burning igniter material powder expels hot particles and gas such as to cause or result in uniform and rapid ignition of the gas generant material.

In practice, the packaging of such igniter materials can be relatively simple and straightforward such as by packaging the igniter material in a small canister, such as made of aluminum, in the center of a toroidal-shaped driver inflator or relatively complex such as by packaging the igniter material in a tubular device which in turn is inserted down a bore of a stack of gas generant wafers in a typical, cylindrically-shaped passenger inflator device. Regardless of the specifics of such designs, the packaging of a powdered igniter material within an inflator device has typically required the inclusion of additional parts and added weight as well as increased assembly and manufacture expense.

An alternative approach has been to press the igniter material into a particle shape with similar dimensions as the gas generant particles and to strategically position these igniter material particles within the gas generant mass in close proximity to the squib. Specific examples of this approach include: igniter material wafers placed or positioned at the end of a gas generant wafer stack next to a squib or placed in a regular periodicity along the length of a gas generant wafer stack; igniter material tablet(s) at the squib end of a bed of gas generant tablets in a side impact inflator; igniter material tablets place down a bore of a gas generant wafer stack; igniter material tablets placed in the center of a bed of gas generant tablets in a toroidal driver inflator; or other similar concepts. Unfortunately, pressed igniter particles typically have a greatly reduced surface area as compared to a similar mass of igniter powder. As will be appreciated, a reduced surface area of the igniter material during combustion will typically result in a reduced rate of energy release therefrom and may therefore cause or result in undesired ignition delays within an airbag inflator device.

In view of the above, there is a need and a demand for an igniter material body that has dimensions similar to those of gas generant particles but which igniter material body provides or results in a surface area similar to those of powdered igniter materials.

SUMMARY OF THE INVENTION

A general object of the invention is to provide an improved igniter body and related methods of making such an igniter body.

A more specific objective of the invention is to overcome one or more of the problems described above.

The general object of the invention can be attained, at least in part, through a method for making a porous igniter body wherein a blowing agent component including at least one thermally decomposable blowing agent solid is mixed with at least one igniter fuel and at least one igniter oxidizer to form an igniter body precursor. The igniter body precursor is subsequently heated to a temperature sufficient to decompose at least a portion of the blowing agent to form the porous igniter body.

The prior art generally fails to provide an igniter material body that has dimensions similar to those of gas generant particles but which igniter material body, when in active use, provides or results in a surface area similar to those of powdered igniter materials.

The invention further comprehends, in accordance with one preferred embodiment, a porous igniter body formed by mixing a blowing agent component including at least one thermally decomposable blowing agent solid with at least one igniter fuel and at least one igniter oxidizer to form an igniter body precursor. The igniter body precursor is subsequently heated to a temperature sufficient to decompose at least a portion of the blowing agent to form the porous igniter body.

In accordance with another preferred embodiment, the invention still further comprehends a porous igniter body for use in conjunction with an automotive safety restraint system squib. The porous igniter body is formed by mixing a blowing agent component including at least one thermally decomposable blowing agent solid with at least one igniter fuel component and at least one igniter oxidizer component to form an igniter body precursor. The igniter body precursor is subsequently heated to a temperature sufficient to decompose at least a portion of the blowing agent to form the porous igniter body which is fracturable upon an incidence of an initiation discharge from an automotive safety restraint system squib.

In accordance with still another preferred embodiment, the invention comprehends an igniter body which includes an igniter composition shaped to form a cupped pellet.

As used herein, references to a specific composition, component or material as a "fuel" are to be understood to refer to a chemical which generally lacks sufficient oxygen to bum completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

Other objects and advantages will be apparent to those skilled in the art from the following detailed description taken in conjunction with the appended claims and drawings.

DETAILED DESCRIPTION OF THE INVENTION

Figure 1:
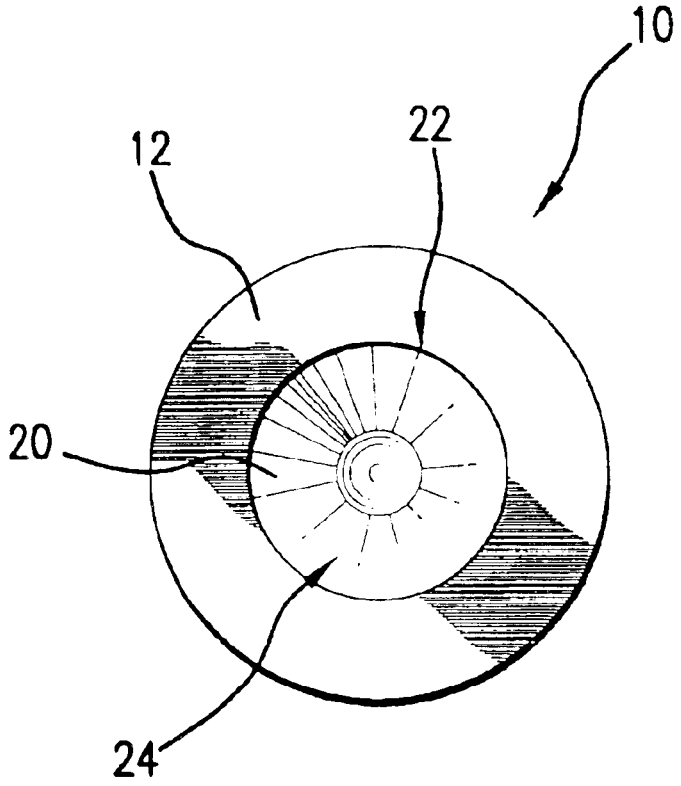
FIG. 1 is a top plan view of a porous igniter body in accordance with one preferred embodiment of the invention.

The present invention provides an igniter material body that has dimensions similar to those of gas generant particles but which igniter material body, such as when in active use, provides or results in a surface area similar to those of powdered igniter materials. More particularly, the invention provides a porous igniter body such as for use in conjunction with an automotive safety restraint system squib and such as fracturable, upon an incidence of an initiation discharge from an automotive safety restraint system squib, such as to form or result in an igniter material powder.

As described in greater detail below, a blowing agent solid, such as in powder form, is desirably mixed with at least one igniter fuel and at least one igniter oxidizer to form an igniter body precursor. In accordance with one preferred embodiment of the invention, an igniter formulation material, such as including at least one igniter fuel and at least one igniter oxidizer, is prepared such as in the form of a granular or powdered material. For example, one or more powdered igniter fuel and one or more powdered igniter oxidizer, as well as other desired igniter formulation ingredients such as release agents, flow additives, pressing aids, etc. and the like and such as known in the art are wet mixed together with an appropriate solvent that partially solubilizes one or more components of the formulation.

The wetted mix is dried and milled to a desired granule size. The powdered igniter formulation is blended with at least one blowing agent solid, typically in powder form. The blended powders are subsequently processed into a desired shape or form. For example, such blended powders can desirably be shaped or formed under force into a desired shape or form (tablet, wafer, pellet or the like, for example) such as by means of rotary pharmaceutical presses, hydraulic presses or other comparable means of pressing and such as to form an igniter body precursor. The igniter body precursor is heat treated to desirably completely decompose and remove the blowing agent. In particular, the blowing agent desirably decomposes or otherwise forms gaseous species such as migrate to the igniter body surface and may be swept away in the convection current of a convection oven such as may be used for such heat treatment. These gaseous species in turn serve to leave pores or other forms of holes, crevices and the like in the igniter body, greatly increasing the surface area of the body and forming a porous igniter body in accordance with the invention.

In accordance with another preferred embodiment, the blowing agent is desirably added to or with one or more igniter ingredients during formulation of the igniter material. For example, the desired blowing agent solid can be wet mixed together with one or more powdered igniter fuel, one or more powdered igniter oxidizer and, if desired, one or more igniter formulation additive ingredients such as release agents, flow additives, pressing aids, etc. such as by using an appropriate solvent that at least partially solubilizes one or more components of the formulation. This wetted mix can then be dried and milled to a desired granule or powder size. The resulting material can subsequently be processed into a desired shape or form, such as described above. For example, material can desirably be shaped or formed under force into a desired shape or form (tablet, wafer, pellet or the like, for example) such as by means of rotary pharmaceutical presses, hydraulic presses or other comparable means of pressing and such as to form an igniter body precursor in accordance with the invention. The igniter body precursor can subsequently be subjected to heat treatment to desirably completely decompose and remove the blowing agent and such as to form a porous igniter body, such as described above. Such inclusion of the blowing agent during formulation of the igniter material may desirably better ensure the formation of a more homogeneous mixture and thus result in a porous igniter body in accordance with the invention having a more uniform or even pore distribution. As will be appreciated, a more uniform or even pore distribution in such porous igniter bodies can, in practice, desirably result in greater reliability in performance.

In accordance with a preferred practice of the invention, the crush strength of the igniter body is reduced during the heat treating process due to the removal of material from the body precursor and slight expansion of the body geometry. The mechanical properties of the heat-treated porous igniter body are generally adequate to allow the porous igniter body to survive normal vibrational stresses such as may be encountered in or associated with use in an inflator. In accordance with a preferred practice of the invention, however, the porosity is desirably sufficient such that the input of a high rate of energy such as in the form of an output blast from an automotive safety restraint system can disintegrate the porous igniter body into a powder thus further increasing the surface area of the provided igniter material.

Suitable blowing agent solids for use in the practice of the invention generally include those blowing agent materials that decompose to gaseous species when subjected to heat. In practice, those blowing agents that at least partially decompose into gas at temperatures below the autoignition temperature of the associated igniter formulation are preferred. Typically, such decomposition temperatures are less than 350° C. such that the igniter body precursor is required to only be heated to a temperature below 350° C. Those blowing agent solids that decompose at temperatures between 100 and 300° C. are believed to be most useful and desirable in the practice of the invention.

Furthermore, while the use of a blowing agent that decomposes into all gaseous species is generally preferred, the broader practice of the invention is not necessarily so limited provided. For example, that any resulting solid decomposition products do not severely inhibit the combustion of the igniter formulation or are otherwise detrimental. Examples of useful blowing agents that typically produce or result in only gaseous products include: ammonium oxalate, azodicarbonamide, ammonium carbonate, ammonium carbamate, ammonium bicarbonate, 4,4' oxydibenzene sulfonyl hydrazide, organic acids, etc. Other useful blowing agents that generally decompose leaving some solids include: alkali and alkaline earth metal carbonates or bicarbonates such as sodium and potassium carbonate or bicarbonate, basic metal carbonates such as basic copper carbonate, metal ammine carbonates such as copper diammine carbonate, metal ammine salts of organic acids such as copper diammine oxalate, and metal salts of organic acids, for example.

In general, the invention can desirably be practiced such that an igniter body precursor in accordance with the invention contains 1 to 50 weight percent of the blowing agent component and preferably such that an igniter body precursor in accordance with the invention contains 5 to 25 weight percent of the blowing agent component.

Those skilled in the art and guided by the teachings herein provided will appreciate that the invention can desirably be applied or practiced in conjunction with various igniter formulations such as have or may find application in inflatable restraint systems. In particular, the invention desirably can be applied to various igniter formulations such as incorporate or employ a selected fuel and oxidizer.

For example, suitable fuel materials in accordance with certain preferred embodiments of the invention include one or more metals, metal hydrides, metalloids (such as boron, silicon, etc.), organic gas producing compounds, inorganic gas producing compounds, and polymeric binders such as a fuel. Suitable oxidizer materials in accordance with certain preferred embodiments of the invention include one or more alkali and alkaline earth metal nitrites, nitrates, chlorates, and perchlorates, ammonium nitrate, ammonium perchlorate, transition metal oxides, hydroxides, carbonates, nitrates, and perchlorates, and transition metal complex nitrates, nitrites, and perchlorates, and fluoropolymers, for example.

In addition, suitable igniter formulations may, if desired, include one or more customary or otherwise standard igniter formulation ingredients such as release agents, flow additives, pressing aids, etc., such as known to those skilled in the art and guided by the teachings herein provided.

Figure 2:
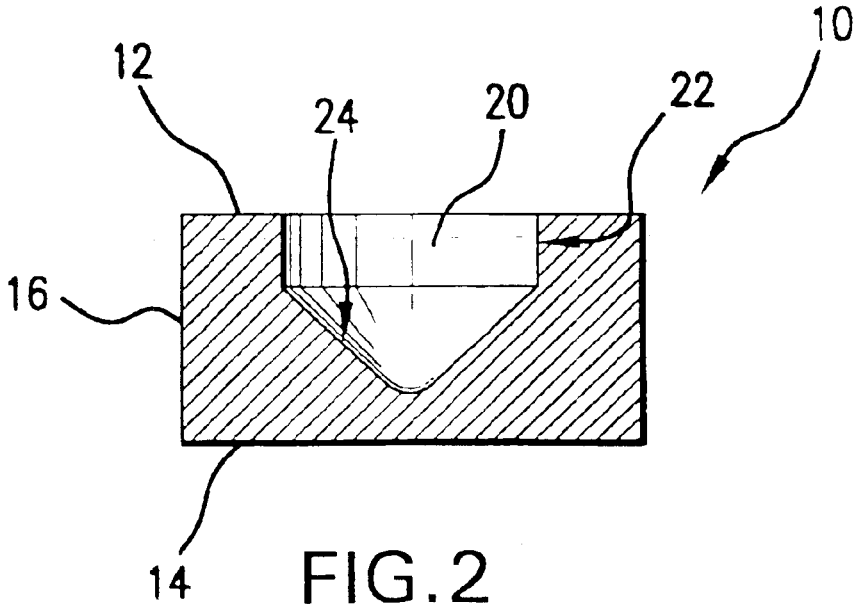
FIG. 2 is a side sectional view of the porous igniter body shown in FIG. 1.

In accordance with one preferred embodiment, the invention can desirably be practiced employing an igniter body precursor and consequently a porous igniter body having a shape or form of a pellet or wafer that is generally cup-shaped, such as shown in FIGS. 1 and 2 and generally designated by the reference numeral 10. The cupped pellet porous igniter body 10 includes a front or top surface or face 12, an opposite bottom or base surface or face 14 and an outer side surface 16 extending therebetween. As shown, the front surface or face 12 includes a generally cup-shaped form or surface geometry, generally designated by the reference numeral 20 and such as includes a generally cylindrical sidewall portion 22 and a base portion 24 such as generally having the general shape of an inverted cone. As will be appreciated, such cup-shaped form 20 can be variously shaped and sized such as may be desired in particular applications such as to facilitate placement or positioning thereof adjacent to an automotive safety restraint system squib (not shown). In particular, the cup-shaped form 20 is desirably shaped and sized such that the discharge end of such an automotive safety restraint system squib extends into or is at least partially placed within the base portion 24 such as to enhance or otherwise improve is discharge communication by and between the squid and the porous igniter body 10.

In general, however, typical igniter formulations in such cup-shaped form porous igniter bodies and weighing in the range of about 2 to about 3.5 grams have generally proven useful and effective in typical or common inflatable restraint system applications. As will be appreciated, the amount of igniter material formulation in such a shaped porous igniter body in accordance with the invention can be easily varied for particular applications such as by altering the length of the cylindrical sidewall portion 22 and thus the amount of the igniter material formulation in the body.

As identified above, porous igniter bodies in accordance with the invention are desirably fracturable upon an incidence of an initiation discharge from an automotive safety restraint system squib. For example, porous igniter bodies in accordance with the invention are desirably fracturable upon an incidence of an initiation discharge from a squib containing 60–400 mg of zirconium potassium perchlorate, commonly referred to as a "ZPP" squib.

Moreover, it will be appreciated by those skilled in the art and guided by the teachings herein provided that, an igniter material body having a cup-shaped pellet or wafer form is not necessarily limited to use with a porous igniter body. Thus, in accordance with another aspect of the invention, an igniter body such as formed without the inclusion of pores, such formed as a result of thermal decomposition of a chemical blowing agent, can advantageously employ such a cup-shaped form. For example, such a cup-shaped form of igniter material can experience enhanced communication with an associated automotive safety restraint system squib and thus at least some of the advantages associated therewith even though such igniter material lacks the increased porosity resulting from decomposition of at least a portion of a thermally decomposable blowing agent solid, such as described above.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

A porous igniter body in the form of a tablet and in accordance with one preferred embodiment of the invention was prepared by blending 85 parts by weight of a powdered igniter formulation, composed of 5.00 wt. % polyacrylamide binder, 71.25 wt. % potassium nitrate, 23.75 wt. % boron with 15 parts by weight of ammonium oxalate monohydrate (blowing agent). The blended powders were pressed into ⅜" diameter tablets at 6700 lbs. force. The finished weight of each tablet was 0.41 grams and the tablets had an average thickness of 0.129". The calculated density of these tablets was 1.76 grams per cm. The tablets were then heat treated at 250° C. for 30 minutes. After this heat treatment, the tablets had an average weight of 0.35 grams each corresponding to a 14.63% weight loss (97.5% of blowing agent decomposed in 30 minutes at this temperature). The heat-treated tablets had an average diameter of 0.400" and an average thickness was 0.145" resulting in an average density of 0.96 g/cc. The radial crush strength (on edge) of a non-porous tablet of the above igniter formulation is approximately 70–80 lbs. The average crush strength of the porous igniter body tablets of this example was only 45 lbs.

Example 2

The performance of the porous igniter body tablets of Example 1 was measured by placing a single 0.35 gram tablet at the top of a bed of gas generant tablets and adjacent to a 60 mg ZPP automotive safety restraint system squib in a test inflator device. In particular, the tablet was placed at the top of a 14 gram bed of perforated gas generant tablets each measuring 0.158" in outer diameter and a length measuring 0.160", and including a perforation hole measuring 0.068" in diameter.

The test inflator was subsequently actuated such as to discharge inflation gas into a test tank equipped with a pressure transducer and a high speed data collection system. The time to measurement of first gas (by measuring pressure) in the test tank was recorded. Three runs were made and the porous igniter body tablets of Example 1 provided or resulted in average time to first gas of only 2.30 milliseconds. This compared to an average time to first gas of 3.38 milliseconds for an igniter tablet prepared of the same igniter formulation but without the addition of a blowing agent in accordance with the invention.

It will be appreciated that a reduction of the time to first gas from 3.38 milliseconds to 2.30 milliseconds is a significant reduction. For example, various applications may require a time to first gas of no more than 2.5 milliseconds. In such applications, the porous igniter body tablets of the invention would satisfy such requirement whereas the non-porous counterpart thereof would result in an unacceptable delay time to the first gas.

In view of the above, the invention generally provides a discreet geometry of igniter material such as formed by consolidation at high force and such as employs or involves heat treatment to evolve a blowing agent with the igniter material body becoming relatively porous but generally retaining its original shape only with increased surface area. The pores are desirably open at the surface of the igniter body and therefore facilitate flame spread and rapid combustion. Furthermore, the process for manufacture of such porous igniter bodies can be accomplished using simple standard pyrotechnic processing equipment and, if desired, can be performed off-line and delivered to a desired inflator assembly facility Thus, the invention provides an igniter material body that has dimensions similar to those of gas generant particles but which igniter material body provides or results in a surface area similar to those of powdered igniter materials. Further, porous igniter bodies in accordance with the invention provide or result in surface areas similar to those of powdered igniter materials without the production and manufacturing complexities and costs normally associated with the inclusion of separate igniter material packaging as has been common in various inflator devices employing a powder form of igniter material.

Consequently, the invention simplifies and reduces the costs associated with the inclusion of an igniter material within devices such as inflator devices employed in automotive safety restraint systems while also minimizing or avoiding ignition delays such as commonly associated with various earlier attempts to simplify igniter material inclusion within such devices.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for making a porous igniter body, the method comprising:

mixing a blowing agent component including at least one thermally decomposable blowing agent solid with an igniter formulation including at least one igniter fuel and at least one igniter oxidizer to form an igniter body precursor, and heating the igniter body precursor to a temperature sufficient to decompose at least a portion of the blowing agent to form a porous igniter body.

2. The method of claim 1 wherein the porous igniter body is fracturable upon an incidence of an initiation discharge from an automotive safety restraint system squib to form a powder.

3. The method of claim 1 wherein the heating of the igniter body precursor comprises heating the igniter body precursor to a temperature below 350° C.

4. The method of claim 1 wherein the mixing step comprises mixing a powder of the at least one thermally decomposable blowing agent solid with a powder comprising the at least one igniter fuel and the at least one igniter oxidizer.

5. The method of claim 4 wherein the at least one igniter fuel and the at least one igniter oxidizer are each part of an igniter formulation having a predetermined autoignition temperature and wherein the heating step comprises heating the igniter body precursor to a temperature below the autoignition temperature of the igniter formulation.

6. A method for making a porous igniter body, the method comprising:

mixing a blowing agent component including at least one thermally decomposable blowing agent solid with at least one igniter fuel and at least one igniter oxidizer to form an igniter body precursor, and heating the igniter body precursor to a temperature sufficient to decompose at least a portion of the blowing agent to form a porous igniter body;

wherein the mixing step comprises mixing a powder of the at least one thermally decomposable blowing agent solid with a powder comprising the at least one igniter fuel and the at least one igniter oxidizer;

wherein the at least one igniter fuel and the at least one igniter oxidizer are each part of an igniter formulation having a predetermined autoignition temperature and wherein the heating step comprises heating the igniter body precursor to a temperature below the autoignition temperature of the igniter formulation and wherein the igniter formulation is prepared by:

wet mixing igniter formulation ingredients including a powder of the at least one igniter fuel and a powder of the at least one igniter oxidizer with a selected solvent effective to at least partially solubilize at least one of the igniter formulation ingredients to form a wetted mixture;

drying the wetted mixture to form a dry mixture; and powderizing the dry mixture to form a powder.

7. A method for making a porous igniter body, the method comprising:

mixing a blowing agent component including at least one thermally decomposable blowing agent solid with at least one igniter fuel and at least one igniter oxidizer to form an igniter body precursor, and heating the igniter body precursor to a temperature sufficient to decompose at least a portion of the blowing agent to form a porous igniter body;

wherein the mixing step comprises mixing a powder of the at least one thermally decomposable blowing agent solid with a powder comprising the at least one igniter fuel and the at least one igniter oxidizer and wherein the method comprises:

wet mixing the at least one thermally decomposable blowing agent solid with the at least one igniter fuel and the at least one igniter oxidizer with a selected solvent effective to at least partially solubilize at least one of the igniter fuel and igniter oxidizer to form a wetted mixture;

drying the wetted mixture to form a dry mixture; and powderizing the dry mixture to form a powder.

8. The method of claim 7 wherein the selected solvent is also effective to at least partially solubilize the at least one thermally decomposable blowing agent solid.

9. The method of claim 4 wherein the mixed powders are pressed formed into a cup-shaped pellet shape.

10. The method of claim 1 wherein the igniter body precursor contains 1 to 50 weight percent of the blowing agent component.

11. The method of claim 1 wherein the igniter body precursor contains 5 to 25 weight percent of the blowing agent component.

12. The method of claim 1 wherein the blowing agent component upon being heated decomposes only into gaseous products.

13. The method of claim 6 additionally comprising press forming the mixed powders to form a cup-shaped pellet shape igniter body precursor.

14. A porous igniter body formed by the method, of claim 6.

15. The method of claim 7 additionally comprising press forming the mixed powders to form a cup-shaped pellet shape igniter body precursor.

16. A porous igniter body formed by the method of claim 7.

17. The method of claim 1 wherein the porous igniter body consists essentially of the igniter formulation.

18. The method of claim 6 wherein the porous igniter body is fracturable upon an incidence of an initiation discharge from an automotive safety restraint system squib to form a powder.

19. The method of claim 6 wherein the heating of the igniter body precursor comprises heating the igniter body precursor to a temperature below 350° C.

20. The method of claim 6 wherein the igniter body precursor contains 5 to 25 weight percent of the blowing agent component.

21. The method of claim 6 wherein the blowing agent component upon being heated decomposes only into gaseous products.

22. The method of claim 6 wherein the mixed powders are pressed formed into a selected shape.

23. The method of claim 7 wherein the porous igniter body is fracturable upon an incidence of an initiation discharge from an automotive safety restraint system squib to form a powder.

24. The method of claim 7 wherein the heating of the igniter body precursor comprises heating the igniter body precursor to a temperature below 350° C.

25. The method of claim 7 wherein the igniter body precursor contains 5 to 25 weight percent of the blowing agent component.

26. The method of claim 7 wherein the blowing agent component upon being heated decomposes only into gaseous products.

27. The method of claim 7 wherein the mixed powders are pressed formed into a selected shape.

28. The method of claim 1 wherein the igniter formulation is prepared by:

wet mixing igniter formulation ingredients including a powder of the at least one igniter fuel and a powder of the at least one igniter oxidizer with a selected solvent effective to at least partially solubilize at least one of the igniter formulation ingredients to form a wetted mixture;

drying the wetted mixture to form a dry mixture; and powderizing the dry mixture to form a powder.

29. A method for making a porous igniter body, the method comprising:

mixing a blowing agent component including a powder of at least one thermally decomposable blowing agent solid with an igniter formulation powder including at least one igniter fuel and at least one igniter oxidizer to form a powder mixture;

press forming the powder mixture to form an igniter body precursor, and heating the igniter body precursor to a temperature below 350° C. and sufficient to decompose at least a portion of the blowing agent to form a porous igniter body.

30. The method of claim 29 wherein the igniter formulation is prepared by:

wet mixing igniter formulation ingredients including a powder of the at least one igniter fuel and a powder of the at least one igniter oxidizer with a selected solvent effective to at least partially solubilize at least one of the igniter formulation ingredients to form a wetted mixture;

drying the wetted mixture to form a dry mixture; and powderizing the dry mixture to form a powder.

31. The method of claim 29 wherein the porous igniter body is fracturable upon an incidence of an initiation discharge from an automotive safety restraint system squib to form a powder.

32. A method for making a porous igniter body, the method comprising:

mixing a blowing agent component including at least one thermally decomposable blowing agent solid with an igniter formulation including at least one igniter fuel and at least one igniter oxidizer, the igniter formulation being prepared by:

wet mixing igniter formulation ingredients including a powder of the at least one igniter fuel and a powder of the at least one igniter oxidizer with a selected solvent effective to at least partially solubilize at least one of the igniter formulation ingredients to form a wetted mixture, drying the wetted mixture to form a dry mixture, and powderizing the dry mixture to form a powder; to form a powder mixture;

press forming the powder mixture to form an igniter body precursor having a shape selected from the group consisting of tablet, wafer and pellet and heating the igniter body precursor to a temperature sufficient to decompose at least a portion of the blowing agent to form a porous igniter body.

33. A porous igniter body made by the method of claim 32.

* * * * *